US006026965A

United States Patent [19]

Berardi et al.

[11] Patent Number: 6,026,965

[45] **Date of Patent: *Feb. 22, 2000**

[54] PROCESS FOR RECOVERING MINERAL PARTICLES, METAL PARTICLES OR SMALL PRECIOUS STONES FROM AN AQUEOUS SLIM ASSOCIATED WITH AN ORE BODY OR MINERAL DEPOSIT OR PROCESSING THEREOF

[75] Inventors: Roberto Berardi, Sudbury; David Krofchak, Copper Cliff; Peter A. C. A. Howe, Scarborough; David M. Howe, Sudbury, all of Canada

[73] Assignee: Ateba Mines Inc., Scarborough, Canada

[ * ] Notice: This patent is subject to a terminal disclaimer.

[21] Appl. No.: 09/275,976

[22] Filed: Mar. 25, 1999

Related U.S. Application Data

[63] Continuation-in-part of application No. 08/838,208, Apr. 16, 1997, Pat. No. 5,893,463.

[51] Int. Cl.[7] ..... B03B 1/00

[52] U.S. Cl. ..... 209/5; 209/902

[58] Field of Search ..... 209/5, 4, 166, 209/902; 210/697; 252/303, 324, 325

[56] References Cited

U.S. PATENT DOCUMENTS

| | | | |
|---|---|---|---|
| 2,374,100 | 4/1945 | Jackson | 210/697 X |
| 4,279,635 | 7/1981 | Krofchak . | |
| 4,597,791 | 7/1986 | Siddall | 209/5 X |
| 4,976,781 | 12/1990 | Mainwaring et al. | 209/5 X |
| 5,893,463 | 4/1999 | Krofchak et al. | 209/5 |

*Primary Examiner*—David H. Bollinger
*Attorney, Agent, or Firm*—Robert F. Delbridge

[57] ABSTRACT

A process for recovering mineral particles, metal particles or small precious stones from an aqueous slime associated with an ore body or mineral deposit or processing thereof, said aqueous slime containing mineral particles, metal particles or small precious stones in suspension with slime particles. The process includes adding a sufficient amount of deflocculating agent to the aqueous slime to cause deflocculation of the slime particles and produce a deflocculated suspension containing the mineral particles, metal particles or small precious stones. The deflocculated suspension is allowed to settle, and the settled material containing the mineral particles, metal particles or small precious stones is recovered.

11 Claims, No Drawings

PROCESS FOR RECOVERING MINERAL PARTICLES, METAL PARTICLES OR SMALL PRECIOUS STONES FROM AN AQUEOUS SLIM ASSOCIATED WITH AN ORE BODY OR MINERAL DEPOSIT OR PROCESSING THEREOF

This application is a continuation-in-part of application Ser. No. 08/838,208 filed Apr. 16, 1997 now U.S. Pat. No. 5,893,463.

FIELD OF THE INVENTION

This invention relates to the recovery of mineral particles, metal particles or small precious stones from aqueous slimes containing such particles in suspension with slime particles. The metal particles may for example be precious metal particles, and the small precious stones may for example be diamonds, sapphires or rubies.

In particular, this invention is concerned with the treatment of any ore body or mineral deposit without regard to mode of origin, of any mineral or metal or small precious stones, in which slime particles are present or formed during the processing of the ore body or mineral deposit.

The term "slime" as used in this application includes any detrital mineral particles of any composition having a diameter less than about 4 microns. This is approximately the upper size limit of particles which can show colloidal properties. Examples of such particles are any earthy extremely fine-grained sediment or soft rock composed primarily of clay-size or colloidal particles and having high plasticity and a considerable content of clay minerals, any wet adhesive earth material, such as mud, any clay minerals composed of essentially hydrous aluminum silicates or hydrous magnesium silicates with extremely small particle size which imparts ability to absorb water and ion on the particle surfaces, or any particles of any shape or size which can cause flocculation in an aqueous suspension or solution.

BACKGROUND OF THE INVENTION

In many cases, the production of a concentrate from an ore involves complex steps which include crushing and grinding the ore in a wet mill and separating the concentrate from the tailings through various mechanical, physical or chemical steps (such as screening, gravity separation or flotation, etc.). A large amount of water is used in all these steps. Although the procedure works fairly well, it has been found that, when the ore is crushed and ground in the mill, very fine particles (slime) are produced and liberated. Such slime particles have distinctive physical-chemical properties which interfere with the recovery process because they encapsulate, sometimes in clay balls, appreciable quantities of minerals, metals or small precious stones which are lost in reject tailings.

So far as is known, this problem has not yet been solved in a cost-effective manner. Attempts have been made to solve the problem by massive dilution with water or separate processing of clay balls. However, both of these procedures are expensive and time consuming.

It is therefore an object of this invention to provide a process for the recovery of mineral particles, metal particles or small precious stones from aqueous slimes containing such particles in suspension with slime particles which substantially eliminates the problem described above.

SUMMARY OF THE INVENTION

The present invention is based on the discovery that slime particles can be separated from the metal or mineral particles or small precious stones by means of a deflocculating agent.

According to the invention, a sufficient amount of deflocculating agent is added to cause deflocculation of the slime particles. The deflocculated suspension is allowed to settle, and the settled material containing the mineral or metal particles or small precious stones is recovered.

DESCRIPTION OF PREFERRED EMBODIMENTS

The manner in which the deflocculating agent can be added to the slime will be readily apparent to a person skilled in the art, and specific examples of the invention will now be described.

EXAMPLE 1

A composite sample of a serpentinite ore body from Ontario, Canada was obtained, and was found to contain lizardite, chrysotile and magnetite as main components. For commercial reasons, it is useful to separate the lizardite (used in automobile brake pads etc.) and the magnetite (used in various industries such as copy machines etc.) fraction from the chrysotile fraction (considered a health risk due to its fibrous and silky characteristics) which creates flocs with the magnetite and the lizardite. Under a stereomicroscope, it was observed that the lizardite and the magnetite were attached to the fibrous particles of the chrysotile. To date, no commercially useful method to separate these three components has been found.

1000 g of the sample were put in water, and a thick flocculated clay-like slime was produced. A 5% solution of sodium tripolyphosphate was added to the slime which liquified, i.e. deflocculated, after mixing. The deflocculated suspension was then allowed to settle for 5 minutes. The chrysotile remained in suspension, while the lizardite and magnetite settled. The chrysotile (73.3% of the original sample) was poured into a receptacle, and was thereby separated from the lizardite (22.9%) and the magnetite (3.8%). The lizardite and the magnetite were separated from each other by a magnetic method.

The water and the sodium tripolyphosphate solution were recovered and reused for other tests, with similar results, namely 72.6% chrysotile, 23.7% lizardite and 3.7% magnetite in one further test, and 72.9% chrysotile, 22.9% lizardite and 4.2% magnetite in yet another test.

EXAMPLE 2

A composite sample of bentonitic black shale with up to 30% Iron-sulphide species was obtained from Alberta, Canada. The rock was very fine and nearly equigranular. This factor may have caused serious problems in concentration by flotation because, after flotation, all the concentrates had the same composition (major and minor elements as well as metals etc.) as the feed material, with there therefore being no actual concentrate.

1000 g of the sample were put in water, and it was observed that the bentonitic fraction did not allow settling and thus separation of the sulfide fraction. A 5% solution of sodium tripolyphosphate was added, and the flocculated suspension liquified after mixing. Virtually all the bentonitic fraction remained in suspension, while the sulfide fraction settled. The bentonitic fraction (54.3% of the original sample) was then poured into a receptacle, and the sulfide fraction (45.7%) was then recovered.

EXAMPLE 3

A composite sample of clay balls (composed mainly of clay, sand and phosphate) was obtained from the discharged outlet of a phosphate plant in Florida, U.S.A. Various attempts in accordance with prior art techniques were made to separate the clay fraction, but none was successful.

1000 g of the sample were put in water, and a 5% solution of sodium tripolyphosphate was added. Immediately after mixing, the clay balls broke down, leaving in suspension the clay fraction (38.7%) was poured into receptacle, and the phosphate and sand fraction (61.3%) which had settled was recovered.

EXAMPLE 4

A sedimentary material from Rancheria, Calif., U.S.A. contained gold and various silicate compounds and clays, some of which had undergone a metamorphism. After this material had been mined, crushed and wet screened, the recovery of gold in a conventional manner was between 45 and 80%. Oversize (reject) material was collected from the trommel whose aperture size was 0.25 inches. 78 lbs. of this reject material, consisting of 63 lbs. of clay balls and 15 lbs. of cemented gravel of fine gold-bearing placer material was placed in a small concrete mixer. A 5% aqueous solution of sodium tripolyphosphate was added in accordance with the invention in an amount such that the weight of sodium tripolyphosphate was 0.4% of the dry weight of the contained clays. The mixture was agitated in the concrete mixer for two hours at a very slow rotation speed. After such agitation, the liquid was decanted off, and the remaining solid material (settled sediment) was dried and weighed.

The dry weight of the sediment was 38 lbs., indicating that 40 lbs. of water and light sediment material had been removed from the original 78 lb. sample. All of the clay balls and about 90% of the cemented gravel has disintegrated. The sediment was then processed in a conventional manner for gold recovery, and about 150 specks of fine gold with a size of about 0.1 to 0.5 mm were observed on the wilfley table. The gold specks were recovered and were found to be 92% of the gold reject material.

EXAMPLE 5

Three similar laboratory tests were carried out using three types of precious stones, namely diamonds, sapphires and rubies.

In the first test, 160 grams of clay from a Costa Rica mine were placed in a beaker, the viscosity of the clay being about 40 centipoises. Ten diamonds, each about 1 mm in diameter, were added and the contents stirred to produce a clay suspension. The contents were then poured into another beaker. Remaining contents in the first beaker were diluted with water and examined. No diamonds had remained behind, i.e. all the diamonds had become entrained in the clay suspension. 5 ml of a 10% aqueous solution of sodium tripolyphosphate was then added to the contents of the second beaker, the weight of sodium tripolyphosphate being 0.1% of the dry weight of the clay in accordance with the invention. The mixture was agitated and then left standing for 30 seconds. The clay had become very liquid with a viscosity of about 5 centipoises and was decanted off, leaving the solid material in the bottom of the beaker. All ten diamonds were recovered in the settled out material.

The test was repeated with ten sapphires of about 2 mm diameter, and these were easily removed in the same way as the diamonds. The test was again repeated with ten rubies of about 2 mm diameter, again with similar results.

Other examples and embodiments of the invention will be readily apparent to a person skilled in the art, the scope of the invention defined in the appended claims.

We claim:

1. A process for recovering mineral particles, metal particles or small precious stones from an aqueous slime associated with an ore body or mineral deposit or processing thereof, said aqueous slime containing mineral particles, metal particles or small precious stones in suspension with slime particles, the process including:

adding a sufficient amount of deflocculating agent to the aqueous slime to cause deflocculation of the slime particles and produce a deflocculated suspension containing the mineral particles, metal particles or small precious stones, allowing the deflocculated suspension to settle, and removing settled material containing the mineral particles, metal particles or small precious stones.

2. A process according to claim 1 wherein the aqueous slime contains from about 0.5 to about 90% slime particles by weight.

3. A process according to claim 2 wherein the slime particles comprise detrital mineral particles having a diameter of less than about 4 microns.

4. A process according to claim 1 wherein the slime particles comprise earthy extremely fine-grained sediment or soft rock composed primarily of clay-size or colloidal particles having high plasticity and a considerable content of clay minerals.

5. A process according to claim 1 wherein the slime particles comprise wet adhesive earth material such as mud or clay minerals composed essentially of hydrous aluminum silicates or hydrous magnesium silicates with extremely small particle size which imparts ability to adsorb water and ions on the particle surfaces.

6. A process according to claim 1 wherein the slime particles comprise particles of a shape or size which can cause flocculation in an aqueous suspension or solution.

7. A process according to claim 1 wherein the deflocculating agent comprises an alkali compound of a phosphorous oxide.

8. A process according to claim 7 wherein the weight of deflocculating agent added is from about 0.01 to about 10% by weight of the dry weight of the slime.

9. A process according to claim 1 wherein the ore body or the mineral deposit comprises a sedimentary, igneous, metamorphic or hydrothermal deposit.

10. A process according to claim 1 wherein the small precious stones comprise diamonds, sapphires, rubies, emeralds or aquamarines.

11. A process according to claim 1 wherein the metal particles comprise precious metal particles of gold, silver or any of the platinum group.

* * * * *